US005771701A

United States Patent [19]

Suh

[11] Patent Number: 5,771,701

[45] Date of Patent: Jun. 30, 1998

[54] OPERATING CONTROL CIRCUIT FOR A REFRIGERATOR HAVING HIGH EFFICIENCY MULTI-EVAPORATOR CYCLE (H.M. CYCLE)

[75] Inventor: Kook Jung Suh, Seoul, Rep. of Korea

[73] Assignee: Samsung Electronics Co., Ltd., Suwon, Rep. of Korea

[21] Appl. No.: 555,811

[22] Filed: Nov. 9, 1995

[30] Foreign Application Priority Data

| | | | |
|---|---|---|---|
| Nov. 11, 1994 | [KR] | Rep. of Korea | 94-29470 |
| Nov. 11, 1994 | [KR] | Rep. of Korea | 94-29472 |
| May 30, 1995 | [KR] | Rep. of Korea | 95-13929 |

[51] Int. Cl.[6] ..... F25D 17/06

[52] U.S. Cl. ..... 62/179; 62/180; 62/229

[58] Field of Search ..... 62/180, 179, 186, 62/229, 442, 203

[56] References Cited

U.S. PATENT DOCUMENTS

| | | | |
|---|---|---|---|
| 2,801,525 | 8/1957 | Bixler | 62/180 X |
| 3,107,502 | 10/1963 | Herndon, Jr. et al. | 62/180 |
| 3,218,819 | 11/1965 | Crotser | 62/442 X |
| 3,320,761 | 5/1967 | Gelbard | 62/180 |

*Primary Examiner*—Harry B. Tanner
*Attorney, Agent, or Firm*—Burns, Doane, Swecker & Mathis, L.L.P.

[57] ABSTRACT

A refrigerator includes first, and second compartments cooled to different temperatures. A first evaporator and first fan are provided in the first compartment, and a second evaporator and second fan are provided in the second compartment. A first switch controls the supply of electrical power to a compressor, the first fan, and the second switch. The second switch is operable to turn on/off the second fan while power is supplied to the compressor and first switch.

6 Claims, 6 Drawing Sheets

OPERATING CONTROL CIRCUIT FOR A REFRIGERATOR HAVING HIGH EFFICIENCY MULTI-EVAPORATOR CYCLE (H.M. CYCLE)

RELATED INVENTIONS

This invention is related to inventions disclosed in concurrently filed application Ser. Nos. 08/556,143 and 08/552,480 by the inventor of record.

BACKGROUND OF THE INVENTION

This invention relates to an operating control circuit for a refrigerator, and more particularly to an operating control circuit for a refrigerator having an evaporator and a fan in each of a refrigerating compartment and a freezing compartment and a control method thereof.

PRIOR ART

Generally, a refrigerator has two compartments, freezing and refrigerating compartments which are cooled at different temperatures from each other. In order to cool the compartments, the refrigerator has some devices for forming a refrigerating cycle. Among these devices, an evaporator is disposed at any one of the compartments so as to cool the compartments by exchanging heat with the inner air of the compartments, and a fan is disposed near the evaporator so as to blow the cool air generated by the heat-exchanging operation into the compartments.

FIG. 1A shows the simple configuration of a prior are refrigerator 1, including a freezing compartment 2 and a refrigerating compartment 3 separated From each other. An evaporator 4 is disposed at the rear wall of the freezing compartment 2, and a fan 5 is positioned above the evaporator 4. Additionally, the refrigerator 1 includes an air flow passage 6 for guiding the cool air generated at the evaporator 4 into the compartments and an air flow passage 6 for guiding the inner air of the compartments to the evaporator 4.

This refrigerating cycle configuration of the refrigerator 1 is shown in FIG. 1B. Namely, it is a closed loop comprising a compressor 7 in which a refrigerant is compressed into a higher temperature and higher pressure state, a condenser 8 in which the compressed refrigerant Ls condensed by exchanging heat with ambient air, a capillary tube 9 in which the condensed refrigerant is expanded, and the above-mentioned evaporator 4, wherein the comprising members are connected to one another by a refrigerant tube. The operation fluid of the refrigerating cycle, the refrigerant, is compressed in the compressor 7, condensed in the condenser 8, expanded in the capillary tube 9, and then evaporated in the evaporator 4. Being evaporated in the evaporator 4, the refrigerant absorbs heat from the inner air of the refrigerator 1 passing the evaporator 4 under the operation of the fan 5.

However, because this prior refrigerator includes one evaporator and one fan, it is difficult to control two spaces with different temperatures from each other. Namely, a freezing compartment should be maintained at one desirable temperature, 21° C. to −15° C. keep food frozen, and a refrigerating compartment should be maintained in an other desirable temperature, −1° C. to 6° C. to keep food cold. Therefore, the prior refrigerator has a complicated control system so that one evaporator refrigerates each one of the two compartments with each desirable temperature. That is, its structure is complex, and it is difficult to control each temperature of the compartments. Additionally, because one evaporator is only used and has a limited refrigerating capacity, there are problems that a freezing and a refrigerating compartment cannot be rapidly refrigerated, and the evaporator cannot quickly deal with each temperature change of the compartments (ex. load change, temperature change of ambient air). In view of these problems, it is necessary to minimize the set temperature changes of each one of the compartments. Moreover, it is desirable that the inner structure of a refrigerator be simplified.

SUMMARY OF THE INVENTION

An object of the present invention is to provide an operating control circuit for a refrigerator and a control method thereof which are capable of controlling temperature individually in freezing and refrigerating compartments.

Another object of the present invention is to provide an operating control circuit for a refrigerator and a control method thereof which provide an evaporator and a fan in each of a freezing and refrigerating compartments, and selectively operate any one of the fans, or operate simultaneously the fans and then are capable of accompanying efficient operation and decreasing energy consumption.

Another object or the present invention is to provide a operating control circuit for a refrigerator and a control method thereof which separately control temperatures of freezing and refrigerating compartments, and then are capable of simplifying the structure of a middle partition.

According to the present invention, a operating control circuit for a refrigerator comprises

- first and second compartments being partitioned from each other and cooled into different temperatures from each other;
- first evaporator and second evaporator being disposed at each one of the compartments;
- first temperature sensing means for detecting the temperature of the first compartment;
- second temperature sensing means for detecting the temperature of the second compartment;
- first and second blow fans mounted in the first and second compartments, respectively, which are connected in parallel to an A.C. power source;
- a compressor connected to the A.C. power source;
- first switching means for turning on the compressor and the second blow fan when second temperature detected by the second temperature sensing means is higher than second set temperature determined by a user and turning off the compressor and the blow fans when the second temperature is lower than the second set temperature;
- second switching means operated under the compressor's and the second blow fan's operations for turning on the first blow fan when first temperature detected by the first temperature sensing means is higher than first set temperature determined by a user and turning off the first blow fan when the first temperature is lower than the first set temperature;
- a control portion for controlling the first and second switching means according to the temperatures detected by the temperature sensing means.

Also, a control method according to the present invention for a refrigerator having first and second temperature sensing means disposed at each of first and second compartments cooled into different temperatures from each other, first and second blow fans mounted in the first and second compartments, first switching means for turning on a compressor and the second blow fan and for turning off the compressor and the blow fans, second switching means for turning on/off the first blow fan when the compressor and the second blow fan are turned on by the first switching means, a control portion for controlling the first and second switching means, comprises a step for reading the temperature data of the first and second compartments per every predetermined time from the temperature sensors;

a step for comparing the detected temperature of the second compartment with the second set temperature determined by a user;

a step for controlling the first switching means so as to turn off the compressor and the blow fans when the temperature of the second compartment is lower than the second set temperature in the comparing step;

a step for comparing the detected temperature of the first compartment with the first set temperature determined by a user when the temperature of the second compartment is higher than the second set temperature in the comparing step;

a step for controlling the first and second switching means so as to turn on the compressor and the blow fans when the temperature of the first compartment is higher than the first set temperature in the comparing step of the temperature of the first compartment;

a step for controlling the first switching means so as to turn on the compressor and the second blow fan and for controlling the second switching means so as to turn off the first blow fan when the temperature of the first compartment is lower than the first set temperature in the comparing step of the temperature of the first compartment. The control method is accomplished by the control portion.

BRIEF DESCRIPTION OF THE DRAWINGS

The invention now will be explained in detail with reference to the accompanying drawings, in which.

DESCRIPTION OF THE PREFERRED EMBODIMENTS

Figure 1A:
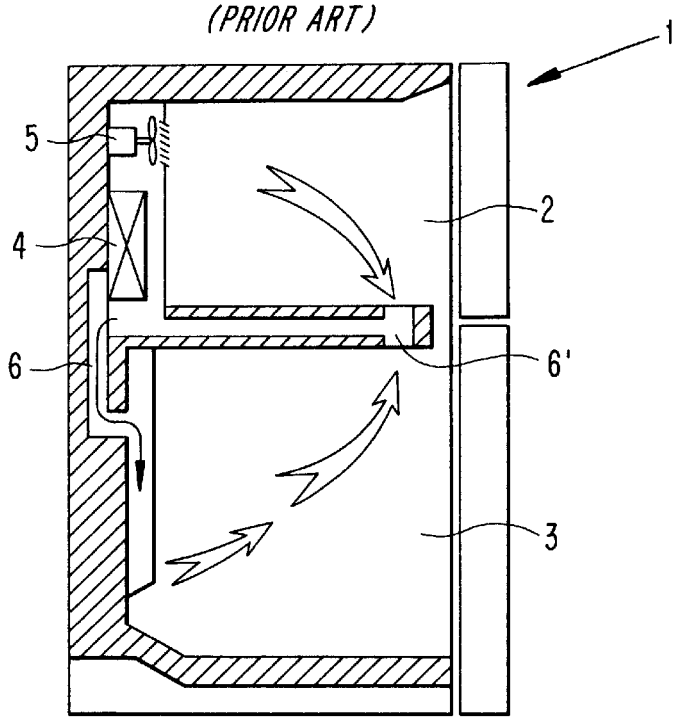
FIG. 1A (PRIOR ART)
FIG. 1A is schematically a side cross-sectional view illustrating a conventional refrigerator.
Figure 1B:
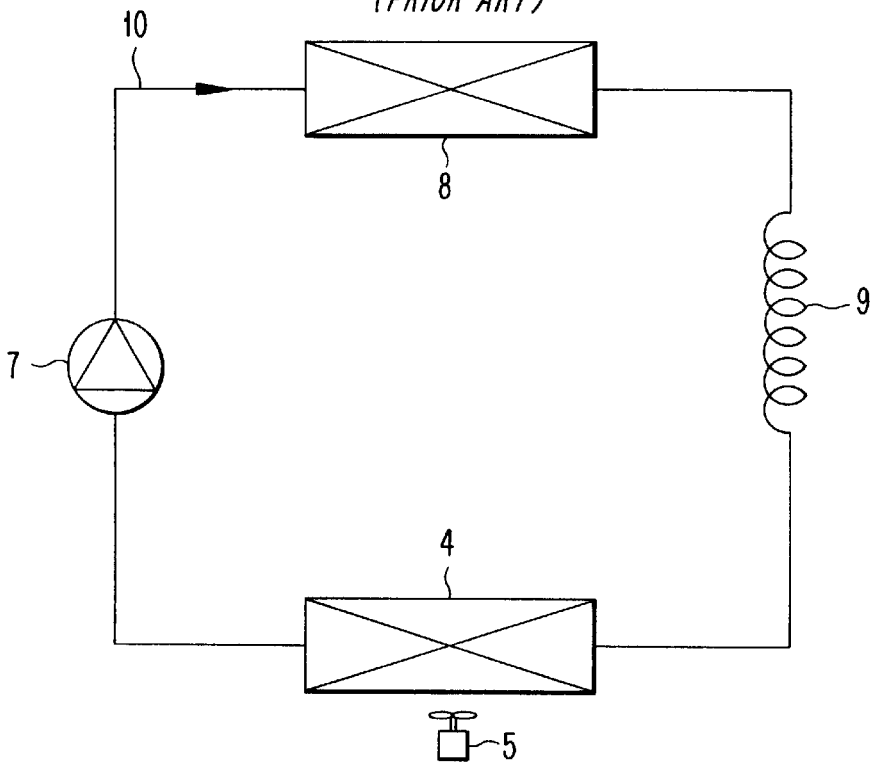
FIG. 1B (PRIOR ART)
FIG. 1B is a view illustrating a refrigerating cycle adapted to a conventional refrigerator.
Figure 2A:
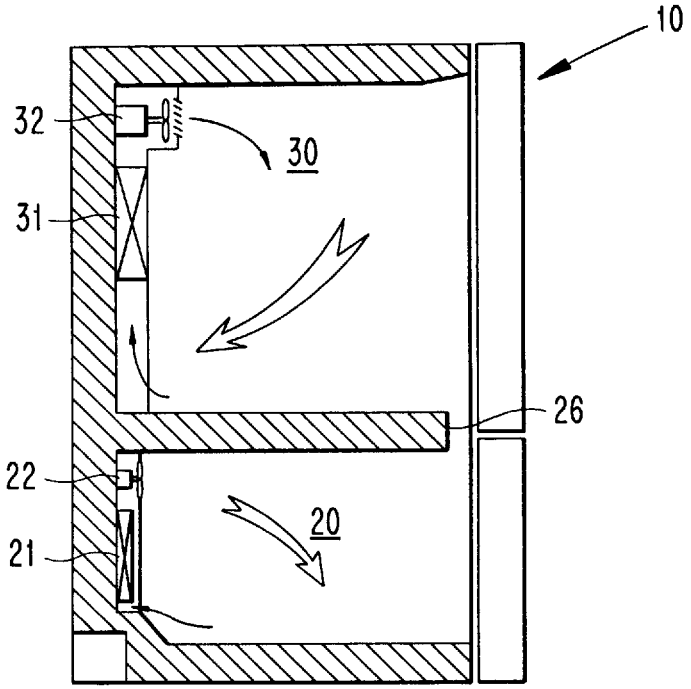
FIG. 2A is schematically a side cross-sectional view illustrating a refrigerator according to the invention.
Figure 2B:
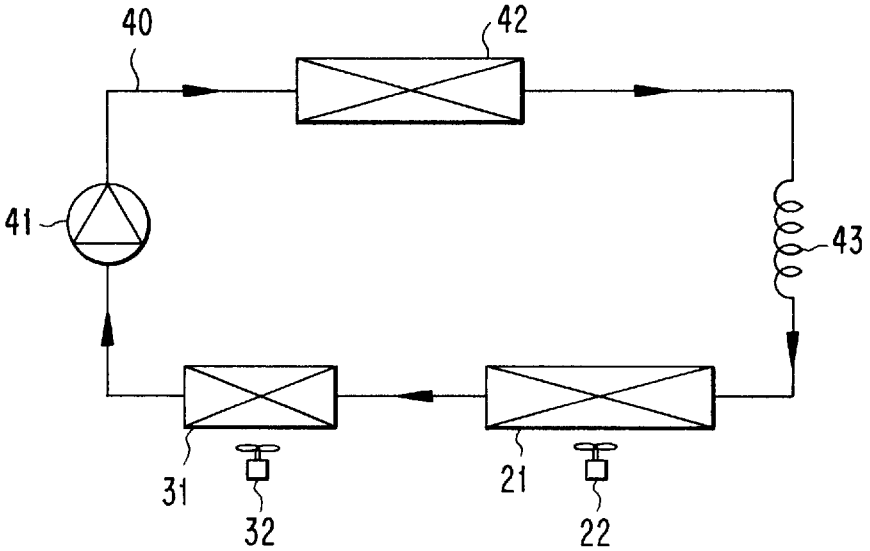
FIG. 2B is a view illustrating a refrigerating cycle adapted to the refrigerator according to the invention.

Referring to FIG. 2A, a refrigerator 10 comprises a freezing compartment 20 and a refrigerating compartment 30 which are divided from each other so as not to allow mixing of the cooling air in the compartments. A first evaporator 21 is mounted in the rear wall of the freezing compartment 20, and a second evaporator 31 is provided in the rear wall of the refrigerating compartment 30. The first and second evaporators 21 and 31 are coupled in series with each other by means of a refrigerant tube 40, which is included in a refrigerating cycle of FIG. 2B. A refrigerating cycle is applied to the invention, which includes a compressor 41, a condenser 42, the first and second evaporators 21 and 31 and a capillary tube 43 connected by means of a refrigerant tube 40 to one another to form closed loop. Because the first and second evaporators 21 and 31 are connected to each Other in series, the refrigerant outputted from the first evaporator 21 flows into the second evaporator 31. Thus, the refrigerant is compressed at the compressor 41, condensed the condenser 42 and then expanded at the capillary tube 43. The expanded refrigerant is evaporated in part while passing through the first evaporator 21 and the remaining amount is gasified while passing through the second evaporator 31, thereby the heat exchanging function is accomplished in each of the compartments. The refrigerant flows into the compressor 41 in a gas state, therefore the refrigerating cycle is completed. The refrigerating cycle is repeated during the operation of the compressor 41.

Herein, it is noted that the first and second evaporators 21 and 31 have their own inherent size and capacity which are designed to be matched with the volumes and control temperatures of the respective compartments 20, 30.

On the other hand, a first fan 22 is mounted adjacent to first evaporator 21 of the freezing compartment 20, and a second fan 32 is mounted adjacent to the second evaporator 31 of the refrigerating compartment 30. The first and second fans 22 and 32 are operated according to the operating of the compressor 41 so as to heat-exchanqe the first and second evaporators 21 and 31 with air circulated in the freezing and refrigerating compartments 21 and 31, respectively. At that time, the temperature of each compartment is controlled at a predetermined temperature. The first and second fans 22 and 32 are connected in parallel to each other to an A.C. power source.

Therefore, the invention does not require any additional structure except for a middle partition 26 as a result of the independent separation of the freezing and refrigerating compartments 20 and 30. In other words, no cooling air flow passage is required in the middle portion 26, and no duct nor damper is needed in the rear wall of the refrigerator. It means the configuration of a refrigerator can be simplified.

Figure 3:
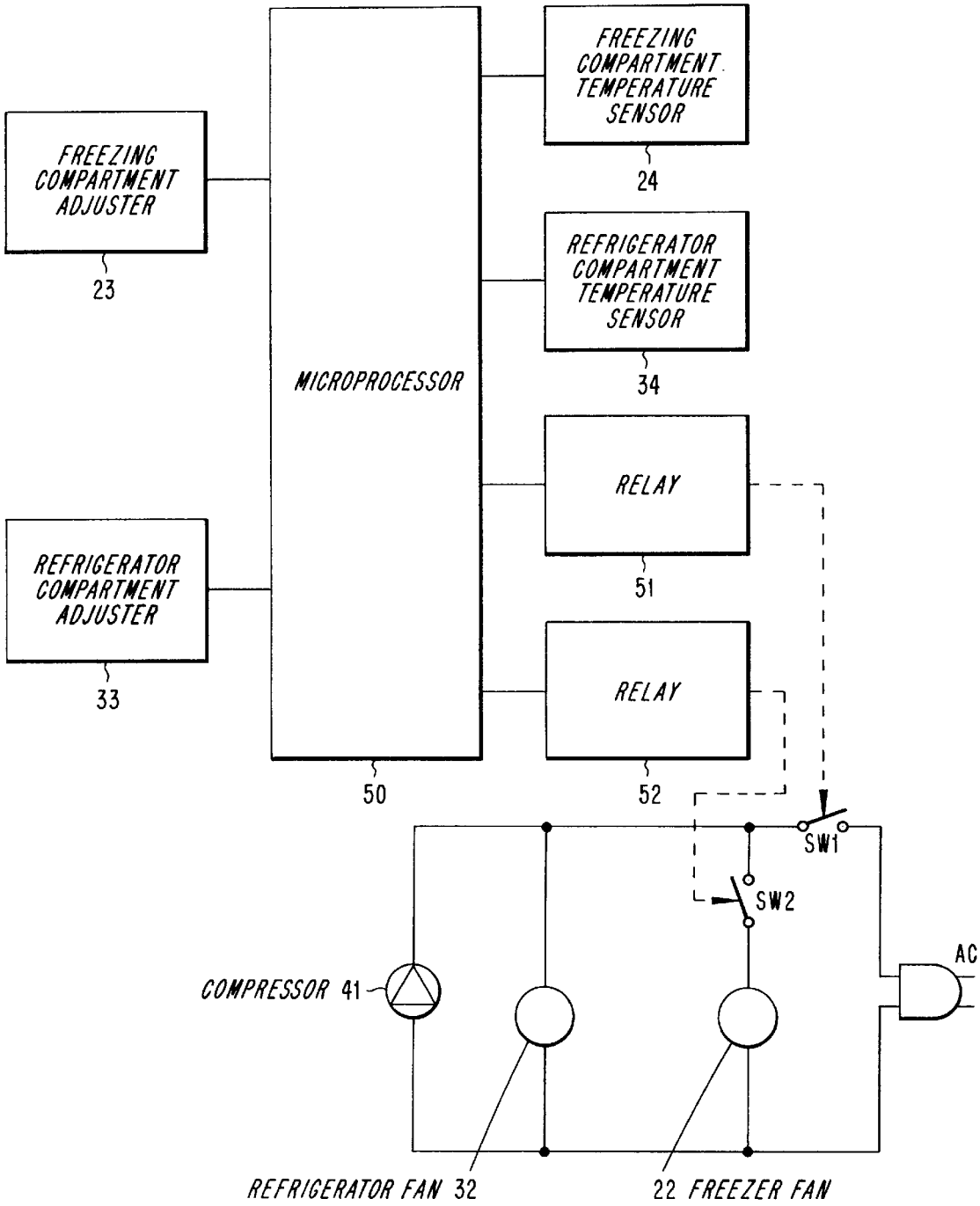
FIG. 3 is an operating control circuit of one embodiment of the invention.

An operating control circuit for controlling the operation of a refrigerator according to one embodiment of the invention is shown in FIG. 3. The operating control circuit comprises a microprocessor 50, including a freezing temperature adjuster 23 for setting the temperature of the freezing compartment 20, a refrigerating temperature adjuster 33 for setting the temperature of the refrigerating Compartment 30 and a freezing temperature sensor 24 for detecting the temperature of the freezing compartment 20, a refrigerating temperature sensor 34 for detecting the temperature of the refrigerating compartment 30 all connected to the inputting of the microprocessor; and first and second relays 51 and 52 connected to its outputting portion. The freezing temperature adjuster 23 is provided on a control panel (not shown) of the refrigerator for setting the temperature of the freezing compartment 20 at an appropriate temperature for the freezing storage of foods. The setting range of the freezing storage temperature is −15° C. to 21° C. Generally, a user sets the temperatures of the freezing compartment 20 within this range. Actually, the set temperature of the freezing compartment 20 is selected to be any one of −21° C. (strong freezing), −18° C. (the middle freezing) and −15° C. (the weak freezing). The refrigerating temperature adjuster 33 is provided on the control panel(not shown) of the refrigerator for setting the temperature of the refrigerating compartment 30 at an appropriate temperature for the refrigerating storage of foods. The setting range of the refrigerating storage temperature is −1° C. to 6° C. Generally, a user sets the temperatures of the refrigerating compartment 30 within this range. Actually, the set temperature of the refrigerating compartment 30 is selected to be any one of 1° C. (the strong refrigerating), 3° C. (the middle refrigerating) and 6° C. (the weak refrigerating). First switch SW1 is connected at one end to an A.C. power source AC and turned on/off according to the operating of first relay 51. The other end of the switch SW1 is connected in parallel to the first and second fans 22 and 32 and the compressor 41. The second switch SW2 is disposed between the first fan 22 and the first switch SW1 and turned on/off according to the operation of second relay 52. Accordingly, when the first switch SW1 is turned on, the compressor 41 and the second fan 32 are turned on. To the contrary, when the first switch SW1 is turned off, the compressor 41 and the first and second fans 22 and 32 are turned off. When the second switch SW2 is turned on, the first fan 22 is turned on To the contrary, when the second switch SW2 is turned of, the first fan 22 is turned off.

In this operating control circuit shown in FIG. 3, the second fan 32 is simultaneously operated with the compressor, and the first fan 22 is operated in accordance with the temperature of the freezing compartment. Accordingly, it is necessary that the first evaporator 21 of the freezing compartment has the highest possible size and the second evaporator 31 of the refrigerating compartment has the lowest possible size matched with the capacity of the refrigerating compartment.

Figure 4:
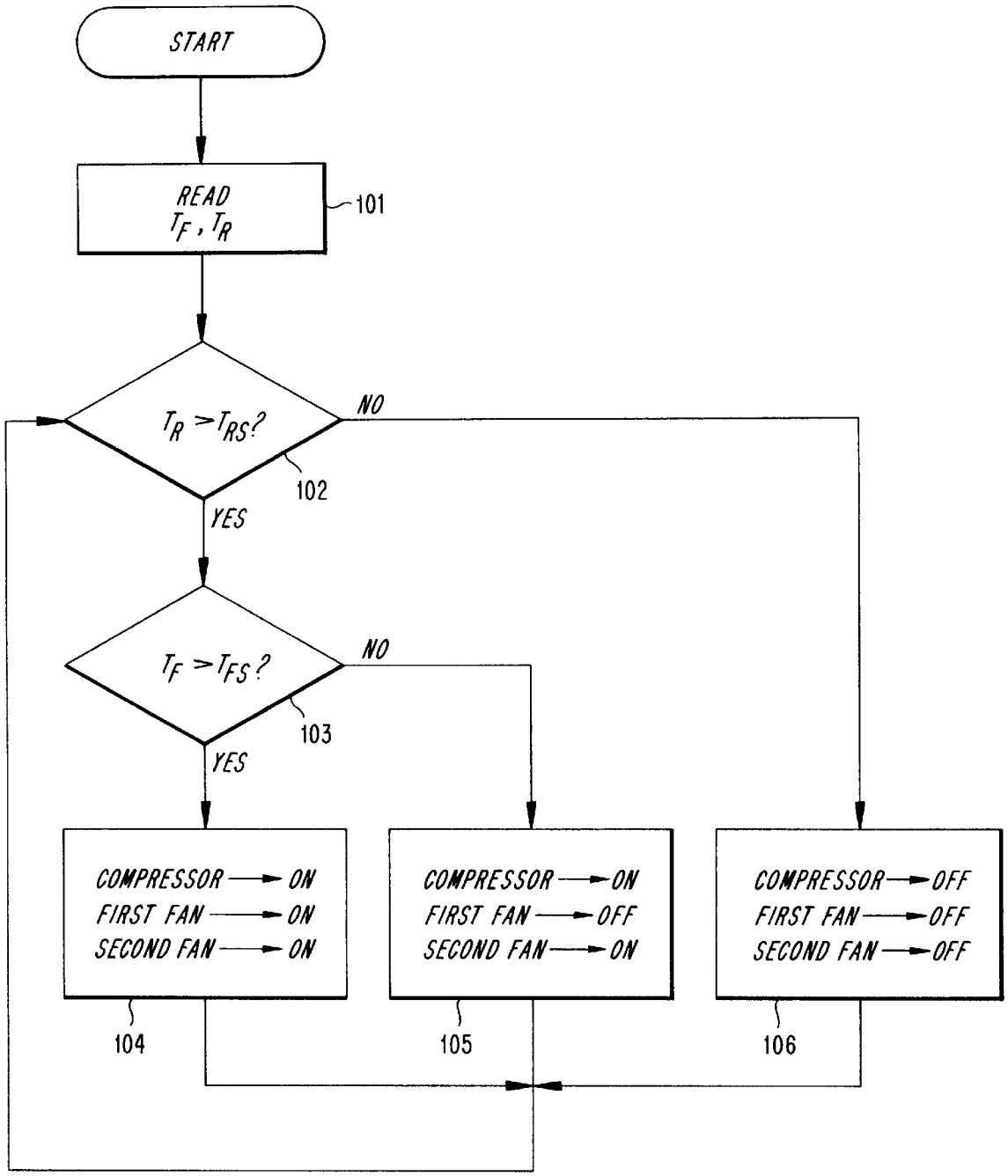
FIG. 4 is a flow chart illustrating the operation of the operating control circuit according to FIG. 3.

According to one embodiment of the invention, as shown in FIG. 4, a microprocessor 50 controls the compressor and the second blow fan in response to the temperature of the refrigerating compartment as follows:

The microprocessor 50 periodically reads the temperature data $T_F$ and $T_R$ of the freezing and refrigerating compartments 20 and 30 from the Freezing and refrigerating temperature sensors 24 and 34 at step 101. In other words, the temperatures $T_F$ and $T_R$ of the freezing and refrigerating compartments 20 and 30 are detected by the temperature sensors 24 and 34 and then inputted to the microprocessor 50 to be checked. Step 101 goes onto step 102 to compare the detected refrigerating temperature $T_R$ with the second set temperature $T_{RS}$ set at the temperature adjuster 33 by the user. At step 103, if the detected refrigerating temperature $T_R$ is higher than the second set temperature the detected freezing temperature $T_F$ is compared with the First set temperature $T_F$ set at the temperature adjuster 23 by the users. If the detected freezing temperature $T_F$ is over the first set temperature $T_{FS}$, control proceeds onto step 104 to operate the first and second relays 51 and 52 for turning on the compressor 41 and the first and second fans 22 and 32. To the contrary, if the detected freezing temperature $T_F$ is below the first set temperature $T_{FS}$, control proceeds onto step 105 to operate the first and second relays 51 and 52 for turning on the compressor 41 and the second fan 32 and turning off the first fan 22. During the operation of the compressor 41 and the first and second fans 22 and 32, if the detected refrigerating temperature $T_R$ is below the second set temperature $T_{RS}$ at step 102; control proceeds onto step 106 to stop the first relay 51 for turning off the first switch SW1. Then, the compressor 41 and the first and second fans 22 and 32 are simultaneously stopped.

Figure 5:
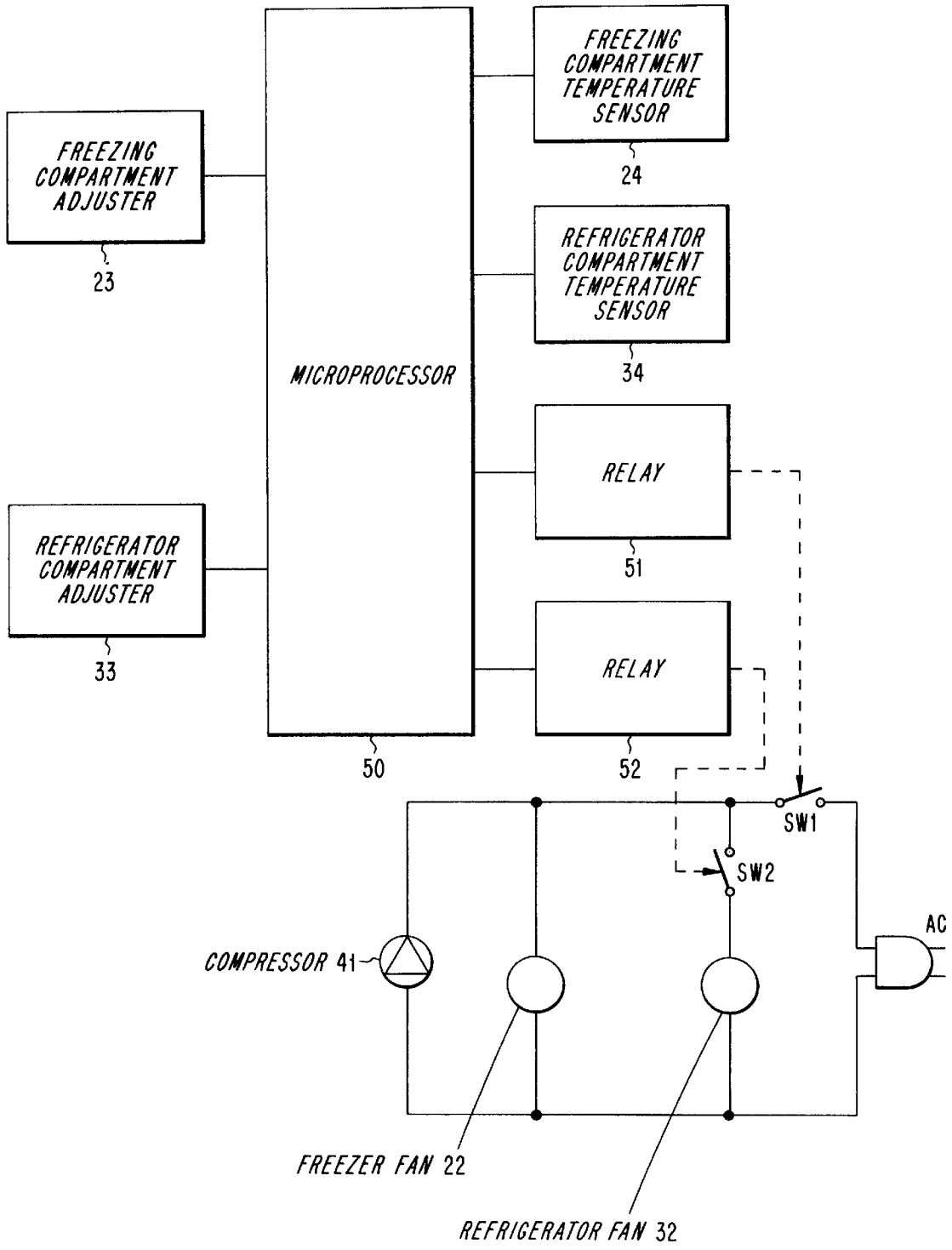
FIG. 5 is an operating control circuit of another embodiment of the invention; and, FIG. 6 is a flow chart illustrating the operation of the operating control circuit according to FIG. 5.
Figure 6:
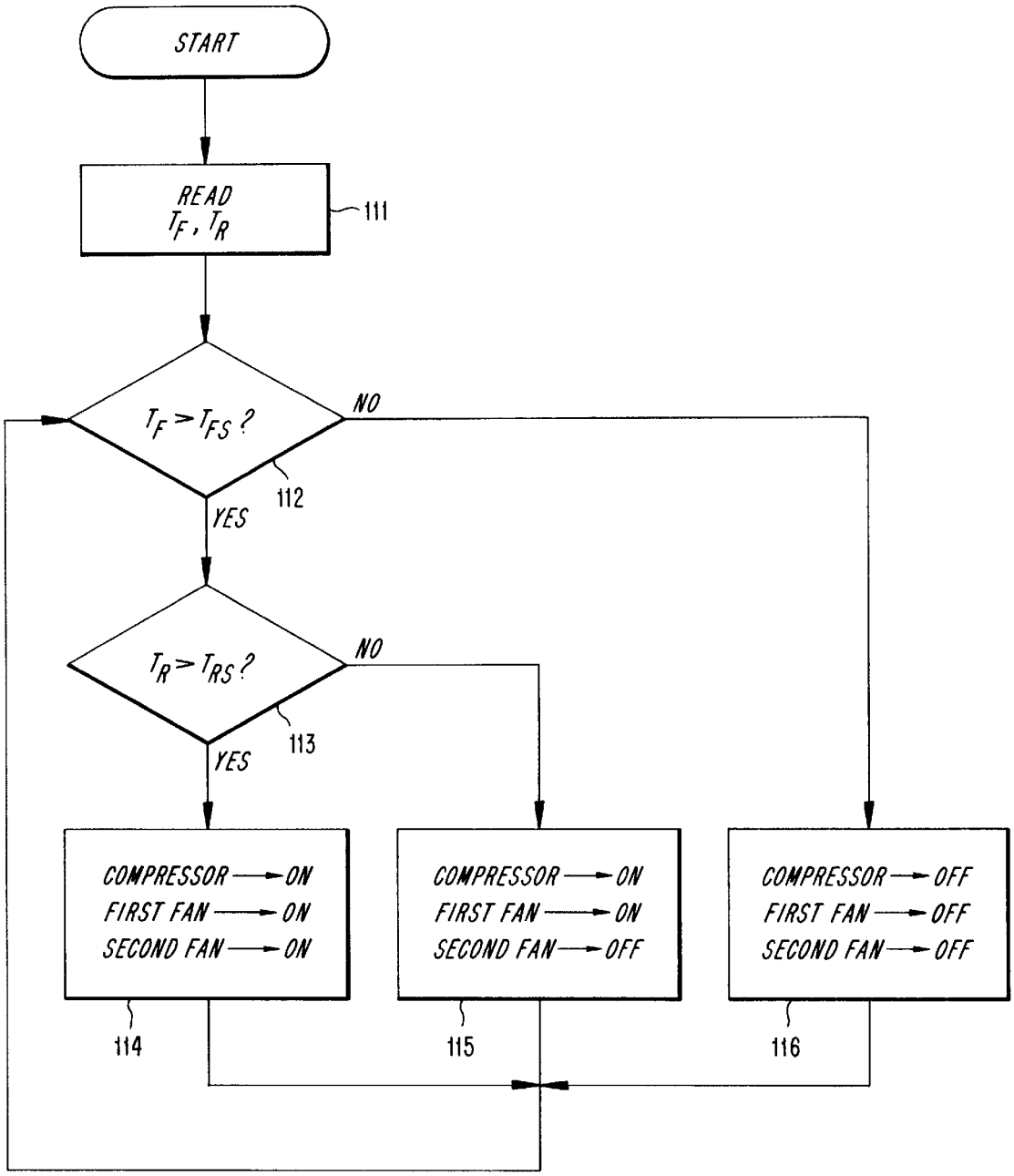

According to a second embodiment of the invention, as shown in FIGS. 5 and 6, an operating circuit controls the compressor and the first fan by the reference of the temperature of a freezing compartment as follows:

The operating control circuit of the second embodiment is similar to the first embodiment of the invention except for the arrangements of the first and second fans. That is, first switch SW1 is connected at one end to an A.C. power source AC and turned on/off according to the operating of first relay 51. The other end of the switch SW1 is connected in parallel to one of the first and second blow fans 22 and 32 and the compressor 41. The second switch SW2 is disposed between the First fan 22 and the first switch SW1 and turned on/off according to the operating of second relay 52. Accordingly, when the first switch SW1 is turned on, the compressor 41 and the first fan 22 are turned on. To the contrary, when the first switch SW1 is turned off, the compressor 41 and the first and second fans 22 and 32 are turned off. When the second switch SW2 is turned on, the second fan 32 is turned on. To the contrary, when the second switch SW2 is turned off, the second fan 32 is turned off.

In this operating control circuit shown in FIG. 5, the first fan is simultaneously operated with the compressor, and the second fan is operated in accordance with the temperature of the refrigerating compartment. Accordingly, it is necessary that the second evaporator of the refrigerating compartment has the highest possible size to have rapid cooling and the first evaporator of the freezing compartment has the highest possible size matched with the capacity of the refrigerating compartment.

According to one embodiment of the invention, as shown in FIG. 6, The microprocessor 50 controls the compressor and the first fan in response to the temperature of the freezing compartment as follows:

The microprocessor 50 reads the temperature data $T_F$ and $T_R$ of the freezing and refrigerating compartments 20 and 30 per every predetermined time from the Freezing and refrigerating temperature sensors 24 and 34 at step 111. In other words, the temperatures $T_F$ and $T_R$ of the freezing and refrigerating compartment 20 and 30 are detected by the temperature sensors 24 and 34 and then inputted to the microprocessor 50 to be checked. Step 111 goes onto step 112 to compare the detected freezing temperature $T_F$ with the first set temperature $T_{FS}$ set by the temperature adjuster 23 for users. At step 113, if the detected freezing temperature $T_F$ is higher than the first set temperature, the detected refrigerating temperature $T_R$ is compared with the second set temperature $T_{RS}$ set by the temperature adjuster 33 for users. If the detected refrigerating temperature $T_R$ is over the second set temperature $T_{RS}$, control proceeds onto step 114 to operate the first and second relays 51 and 52 for turning on the compressor 41 and the first and second fan 22 and 32. To the contrary, if the detected refrigerating temperature $T_R$ is below the second set temperature $T_{RS}$, control proceeds onto step 115 to operate the first and second relays 51 and 52 for turning on the compressor 41 and the first fan 22 and turning off the second fan 32. During the operation of the compressor 41 and the first and second blow fans 22 and 32, if the detected freezing temperature $T_F$ is below the first set temperature $T_{FS}$ at step 102, control proceeds onto step 116 to stop the first relay 51 for turning of the first switch SW1. Then, the compressor 41 and the first and second blow fans 22 and 32 are simultaneously stopped.

As described above, the invention realizes the simple structure thanks to the removal of any air flow passage and minimizes amount of refrigerant usage and reduces energy consumption by the efficient operating control which operates the first and/or second blow fans 22 and/or 32 according to the freezing and refrigerating temperatures detected by the sensors. Namely, when two compartment have inner unsatisfied temperatures, the invention cools the two compartments, or when a compartment is unsatisfied and the other compartment is satisfied, the invention cools only the unsatisfied compartment, thereby unnecessary energy consumption incurred by the cooling of a satisfied compartment is prevented.

What is claimed is:

1. A refrigerator comprising:

at least first and second cooling compartments operating at different temperatures, respectively;

a refrigeration circuit including first and second evaporators communicating with the first and second compartments, respectively, and a compressor for compressing refrigerant supplied to the first and second evaporators;

a first temperature sensor for sensing a temperature of the first compartment;

a second temperature sensor for sensing a temperature of the second compartment;

first and second fans for circulating air across the first and second evaporators, respectively, the first and second fans connected in parallel relative to a power source;

first and second switches, the first switch interconnecting the power source with the compressor, the first fan, and the second switch for supplying power thereto, the second switch interconnecting the first switch with the second fan for turning on/off the second fan during operation of the compressor and first fan; and a control mechanism connected to the first and second sensors and the first and second switches for automatically controlling the first and second switches in response to temperatures detected by the first and second sensors;

the first switch connected to the first fan and the compressor in the refrigeration circuit such that power is always supplied to the first fan whenever power is supplied to the compressor, and power is always supplied to the compressor whenever power is supplied to the first fan.

2. The refrigerator according to claim 1 wherein the first and second compartments are freezing and refrigerating compartments, respectively.

3. The refrigerator according to claim 1 wherein the first and second compartments are refrigerating and freezing compartments, respectively.

4. A method for controlling the operation of a refrigerator having at least two separate cooling compartments operating at different respective temperatures; evaporators communicating with respective ones of the cooling compartments; first and second fans communicating with respective evaporators and connected in parallel to a power source; a compressor connected in parallel to the fans and the power source; first and second switches; the first switch interconnecting the power source with the compressor, the first fan, and the second switch for supplying power thereto; the second switch interconnecting the first switch with the second fan for turning on/off the second fan during operation of the compressor and first fan; the method comprising the steps of:

A) sensing, periodically, the temperatures of the first and second compartments;

B) comparing the sensed temperature of the first compartment with a first reference temperature;

C) actuating the first switch to block the supply of power to the compressor, first fan, and second switch when the sensed temperature of the first compartment is lower than the first reference temperature;

D) comparing the sensed temperature of the second compartment with a second reference temperature when the sensed temperature of the first compartment is higher than the first reference temperature in step B;

E) activating the first and second switches to supply power to the compressor, and the first and second fans when the sensed temperature of the second compartment is higher than the second reference temperature in step D; and F) activating the first and second switches to supply power to the compressor and the first fan, and block the supply of electrical power to the second fan, when the temperature of the second compartment is lower than the second reference temperature in step D, wherein power is always supplied to the first fan whenever power is supplied to the compressor, and power is always supplied to the compressor whenever sower sis supplied to the first fan.

5. The method according to claim 4 wherein step B comprises sensing periodically, a temperature of a freezing compartment defining said first compartment, and a temperature of a refrigerating compartment defining said second compartment.

6. The method according to claim 4 wherein step B comprises sensing, periodically, a temperature of a refrigerating compartment defining said first compartment, and a temperature of a freezing compartment defining said second compartment.

* * * * *